US006842154B1

(12) United States Patent
Apostolos

(10) Patent No.: US 6,842,154 B1
(45) Date of Patent: Jan. 11, 2005

(54) DUAL POLARIZATION VIVALDI NOTCH/ MEANDER LINE LOADED ANTENNA

(75) Inventor: John T. Apostolos, Merrimack, NH (US)

(73) Assignee: BAE Systems Information and Electronic Systems Integration, Nashua, NH (US)

( * ) Notice: Subject to any disclaimer, the term of this patent is extended or adjusted under 35 U.S.C. 154(b) by 0 days.

(21) Appl. No.: 10/629,659

(22) Filed: Jul. 29, 2003

(51) Int. Cl.[7] ..... H01Q 13/10
(52) U.S. Cl. ..... 343/767; 343/770
(58) Field of Search ..... 343/725, 767, 343/770

(56) References Cited

U.S. PATENT DOCUMENTS

| | | | | | |
|---|---|---|---|---|---|
| 4,853,704 | A | | 8/1989 | Diaz et al. | |
| 5,227,808 | A | * | 7/1993 | Davis | 343/915 |
| 5,268,701 | A | * | 12/1993 | Smith | 343/767 |
| 5,467,099 | A | * | 11/1995 | Bonebright et al. | 343/767 |
| 5,519,408 | A | * | 5/1996 | Schnetzer | 343/767 |
| 5,557,291 | A | * | 9/1996 | Chu et al. | 343/725 |
| 5,786,792 | A | * | 7/1998 | Bellus et al. | 343/770 |
| 5,790,080 | A | | 8/1998 | Apostolos | |
| 6,313,716 | B1 | | 11/2001 | Apostolos | |
| 6,323,814 | B1 | | 11/2001 | Apostolos | |
| 6,373,440 | B2 | | 4/2002 | Apostolos | |
| 6,373,446 | B2 | | 4/2002 | Apostolos | |
| 6,404,391 | B1 | | 6/2002 | Apostolos | |
| 6,480,158 | B2 | | 11/2002 | Apostolos | |
| 6,492,953 | B2 | | 12/2002 | Apostolos | |

OTHER PUBLICATIONS

P.G. Gibson of Phillips Research Laboratories, Redhill, Surrey, England, "The Vivaldi Aerial," 1978.

Ramakrishna Janaswamy and Daniel H. Schaubert, "Analysis of the Tapered Slot Antenna," IEE Transactions on Antennas and Propagation, vol. AP–35, No. 1, Sep., 1987.

* cited by examiner

*Primary Examiner*—Tho Phan
(74) *Attorney, Agent, or Firm*—Daniel J. Long; Robert K. Tendler

(57) ABSTRACT

The combination of a Vivaldi notch and a meander line loaded antenna for ultra wide bandwidth is provided with dual polarity by providing orthogonally oriented Vivaldi notched structures coupled to each other at the edges thereof. Mode selection is provided by selectively switching between linear and circular polarization modes through selective input coupling techniques. Each side of the dual polarity Vivaldi notch/MLA plates includes a bifurcated plate with one end of the bifurcated plate having exponentially curved Vivaldi notch surfaces ahead of a cavity opened at the rear end to the bifurcated notch. The side plates for the top plate structure are themselves Vivaldi notch structure, with their side plates being the ajoining top or bottom plate. In each case, internally carried meander lines connect the adjacent together.

11 Claims, 5 Drawing Sheets

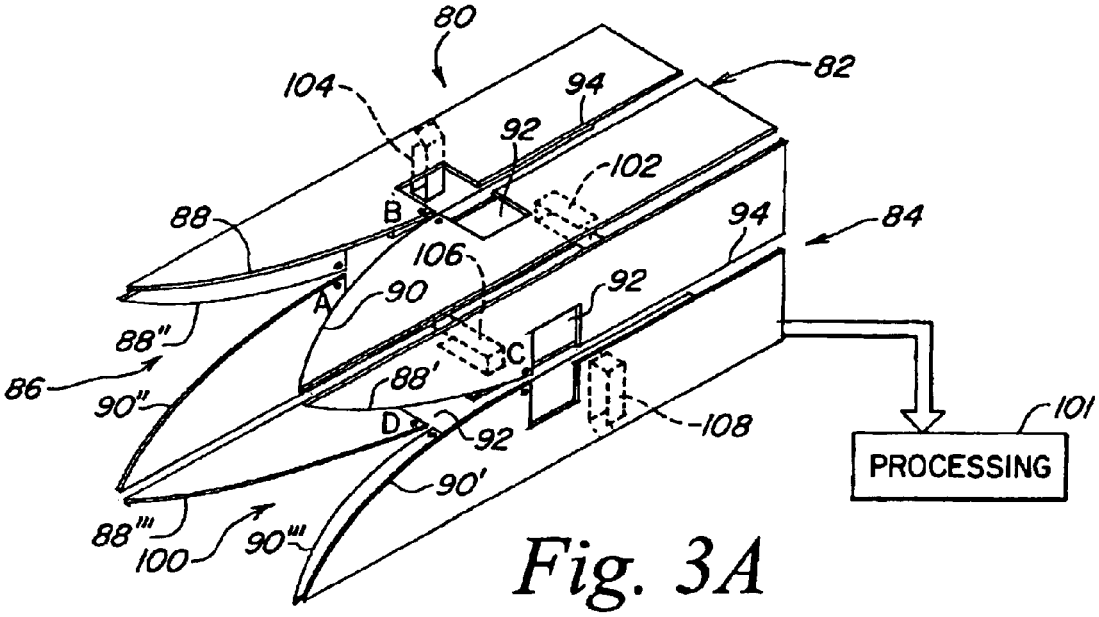
Fig. 3A
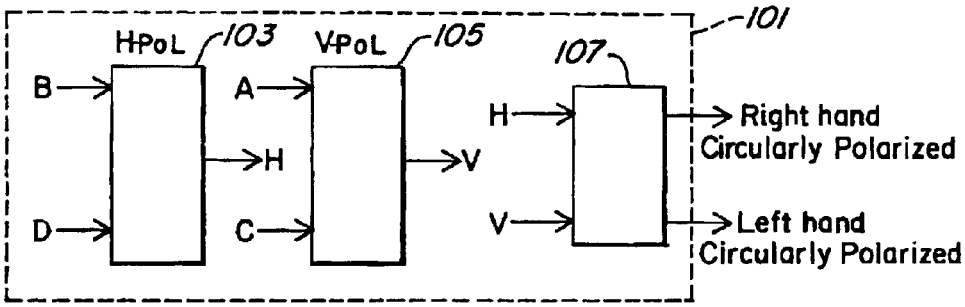
Fig. 3B
Mode Table
| | VPoL | HPoL | RH C-PoL | LH C-PoL |
|---|---|---|---|---|
| A | 1 | 0 | 1 | 1 |
| B | 0 | 1 | −i | +i |
| C | 1 | 0 | 1 | 1 |
| D | 0 | 1 | −i | +i |
Fig. 4

DUAL POLARIZATION VIVALDI NOTCH/ MEANDER LINE LOADED ANTENNA

FIELD OF THE INVENTION

This invention relates to ultra wideband antennas and more particulary to the provision of a dual polarity Vivaldi Notch/Meander Line loaded antenna system.

BACKGROUND OF THE INVENTION

The Vivaldi Notch/Meander Line loaded Antenna (MLA)

As described in a co-pending patent application Ser. No. 10/629,454 filed on even date herewith by John F. Apostolos, entitled "Combined Ultra Wideband Vivaldi Notch/Meander Line Loaded Antenna" assigned to the assignment hereof and incorporated herein by reference, a Vivaldi notch structure in one plane is provided, which yields a 100:1 bandwidth characteristic. This antenna has a horizontal or linear polarization characteristic, which while exceedingly useful in horizontally polarized antenna scenarios, is not as effective as it might be when dealing with circularly polarized applications.

As will be appreciated, there has long been a requirement for a very wideband array antenna to cover, for instance, a band of 100:1 or even 300:1. The purpose of such an antenna is for any ultra wideband application in which one seeks to have a single lobe from the antenna array uncorrupted by so called grating lobes which are the spurious lobes which are the result of standing waves in the elements and element spacings greater than 0.5 wavelength.

An array of bow tie elements suffers from grating lobes introduced by the many periods of oscillation in the element itself, and by the resulting large spacing of the elements.

In order to eliminate the generation of multiple lobes, one would need some sort of traveling wave antenna with a width less than 0.5 wavelength at the highest frequency.

One such traveling wave antenna is a Vivaldi notch antenna The Vivaldi notch antennas are those which have exponentially tapered notches which open outwardly from a feed at the throat of the notch. Typically, in such a Vivaldi notch antenna there is a cavity behind the feed point which prevents energy from flowing back away from the feed point to the back end of the Vivaldi notch. As a result, in these antennas, one obtains radiation in the forward direction and obtains a single lobe beam over a 10:1 frequency range. One can obtain a VSWR less than 3:1 with the beams staying fairly constant over the entire antenna bandwidth with the lobe having about a 80° or 90° beam width.

As can be seen, the Vivaldi notch antennas are single lobe antennas which have a very wide bandwidth and are unidirectional in that the beam remains relatively constant as a single lobe over a 10:1 bandwidth both in elevation and in azimuth.

Note that a constant beam width is maintained because at high frequencies at the throat of the notch only a small area radiates. As one goes lower and lower in frequency, the wider parts of the notch are responsible for the radiating. As a result, the beam width tends to remain constant and presents itself as a single lobe.

The Vivaldi notch antennas were first described in a monograph entitled The Vivaldi Aerial by P. G. Gibson of the Phillips Research Laboratories, Redhill, Surrey, England in 1978 and by Ramakrishna Janaswamy and Daniel H. Schaubert in IEEE Transactions on Antennas and Propagation, vol. AP-35, no.1, September 1987. The above article describes the Vivaldi aerial as a new member of the class of aperiodic continuously scaled antenna structures which has a theoretically unlimited instantaneous frequency bandwidth. This antenna was said to have significant gain and linear polarization that can be made to conform to constant gain versus frequency performance. One reported Gibson design had been made with approximately 10 dB gain and a minus −20 dB side lobe level over an instantaneous frequency bandwidth extending from below 2 GHz to about 40 GHz.

One Vivaldi notch antenna is described in U.S. Pat. No. 4,853,704 issued Aug. 1, 1989 to Leopold J. Diaz, Daniel B. McKenna, and Todd A. Pett. The Vivaldi notch has been utilized in micro strip antennas for some time and is utilized primarily in the high end of the electromagnetic spectrum as a wide bandwidth antenna element.

The problem with Vivaldi notch antennas is that at low frequencies, the notch becomes a short circuit. If one attempts to feed a short circuit at low frequencies, one obtains no output.

There is therefore a necessity for providing an array antenna element which has the favorable characteristics of the Vivaldi notch antennas, yet is able to me made to operate at much lower frequencies.

The problem, however, with making these antennas operate at much lower frequencies, is that as one goes lower in frequency, the antenna elements themselves become larger. When one attempts to array these elements, since the array elements are larger, their separation often exceeds a 0.5 wavelength. Separations over a 0.5 wavelength result in unwanted multiple lobes called grating lobes.

It has been found that if one wants to avoid grating lobes, then the spacing between the antenna elements must be less than a 0.5 wavelength. It is therefore important to be able to fabricate an antenna with exceedingly small antenna elements so as to avoid the unwanted grating lobes while offering wideband performance.

As described in the aforementioned co-pending application, in order to obtain an ultra wideband antenna element for use in an array, an antenna can be configured in a small package such that the Vivaldi notch antenna is combined with a meander line loaded antenna structure such that for higher frequencies, the Vivaldi notch dominates, whereas for the lower frequencies, the meander line loaded antenna functioning as a dipole provides a wide bandwidth low end for the antenna element. Because the meander line loaded structure reduces element size, this combination can be arrayed without producing grating lobes.

In order to form the dipole necessary for the meander line loaded antenna, the Vivaldi notch antenna rather than being provided with a closed end cavity, is provided with the rear end of the cavity opened up with a rearward slot so that at the lower frequency range, the antenna element starts to look like a dipole. Since the feed point is no longer shorted out at the lower frequencies, the result is that one has a fairly fat dipole. The problem with such an arrangement is how to make the dipole work over a 10:1 frequency range of its own accord.

In order to do so, one utilizes the meander line loaded antenna structure to make the dipole work over a wide bandwidth by canceling out reactances at the low end of the frequency range. Such operation is described in U.S. patent application Ser. No. 10/123,787 filed Apr. 16, 2002 by John T. Apostolos entitled "Method and Apparatus for Reducing the Low Frequency Cut-off of a Meander Line Loaded Antenna", assigned to the assignee hereof and incorporated herein by reference.

In one embodiment, the antenna is provided with a Vivaldi notch in an upper plate which is bifurcated down its length. Two side plates vertically depend downwardly from respective top plates and are spaced from the top plates at either edge. The side plates are coupled to the top plate through a meander line structure, the purpose of which is to cancel reactances. The result is an overall ultra wideband structure that is small. When this structure is arrayed, the resulting structure does not violate the restriction that the spacing between the elements not be greater than 0.5 wavelength at the highest frequency. This means that the arrayed antenna elements will exhibit no grating lobes across the entire ultra wideband range, and results in an ultra wideband single lobe antenna array.

It has been found that by combining the two technologies, namely the Vivaldi notch antenna and the meander line technology, at the high frequency the Vivaldi notch is the active radiator, which doesn't see the meander line at all. At the higher frequencies, the gap on the top plate is not seen, and the Vivaldi notch works as it would work normally at the higher frequencies.

As the operating frequency gets lower and lower, the dipole begins to come into play, and the Vivaldi notch becomes less prominent. There is a transition region in which the notch and the dipole are now equally radiating. However, as one goes lower in frequency, the notch is not seen, and one simply is left with the dipole augmented with the meander line structure.

The meander line structure is utilized to give the dipole the increased bandwidth by canceling out the reactances at the low end of the frequency band. This gives an exceptionally good match down to the very low frequencies.

It has been found that the transition region between the Vivaldi notch and the meander line loaded antenna is smooth, and that there is no discontinuity. The result is that one can provide that the antenna work over a 50:1 frequency range.

When one seeks to put these elements in an array, due to their size the separation of the elements is not more than a 0.5 wavelength at the highest frequency, thus eliminating the possibility of creating grating lobes. If the spacing were for instance to become more on the order of a wavelength, one would obtain the undesirable multi-lobe pattern.

It has been found that the combined Vivaldi notch/meander line loaded antenna when arrayed can work over a range of 50 MHz and 1500 MHz. Note that the spacing of the elements is less than a 0.5 wavelength at the highest frequency. As one goes down to $1/50^{th}$ of the highest frequency, then the 0.5 wavelength divided by 50 is 0.01 wavelengths at the low end of the frequency spectrum for the element. Thus for low frequencies, the spacing requirement is overly met, whereas at the highest frequencies the spacing requirement is just met.

It will be appreciated that for an effective radiator, it is the volume of the structure which counts. Even though the element at the lowest frequency is very narrow, one nonetheless obtains volume in the longitudinal direction or axis of the antenna element.

When the antenna elements are arrayed, one also obtains height and depth so that the total volume is such that it is still efficient at the low end of the frequency spectrum, even though its lateral dimension is 0.01 wavelengths in width.

It will be appreciated that that the utilization of the Vivaldi notch along with the meander line loaded antenna configuration means that the elements are so small in the width direction that when the elements are arrayed, grating lobes are prevented from being generated.

If one were going to use some other technology in order to work over a frequency range of 100:1, one could presumably use bow tie structures. However, at the lowest frequency of operation of a bow tie, one would have at least $1/10^{th}$ of a wavelength which means that if one wanted to go up to 100:1 in frequency, then the structure at the high frequency would be 10 wavelengths long, resulting in a severe multi-lobe pattern.

It has been found that the only other antenna element that could work is the meander line itself, but the meander line itself only works over a frequency range of approximately 5–7:1. It does not achieve the 100:1 frequency range that is required. Absent combining with a Vivaldi notch merely using meander line structures will not yield an ultra wideband result.

Providing a single lobe ultra wideband antenna is useful in ultra wideband authorization for wireless as well as other applications. In these applications, one does not want to have spurious side lobes or multiple lobes. Ultra wideband applications such as for instance covert communications, high data rate communications, burst communications, through-the-wall communications, ground-penetrating radar, and others, involve the sweeping of a frequency of, for instance, between 1.5 GHz and 100 GHz.

Using the above combination, one is now able with the combined Vivaldi notch and meander line structure to achieve an ultra wideband result. When arrayed, these antenna elements can be made to have a single lobe characteristic. One can therefore provide an antenna array whose elements are compact and whose spacing between the elements is less than a 0.5 wavelength.

Switchable Polarization

While the Vivaldi notch portion of the antenna described above lies essentially in one plane and has an E-field parallel to that plane thus to make it linearly polarized in the horizontal direction, it is often times desirable to be able to provide a vertically-polarized antenna or one which has a right hand or left hand circular polarization. Then if a transmission is either right hand circularly polarized or left hand circularly polarized, it is desirable to match this polarization to the receiving antenna and vice versa.

If trying to communicate with a land vehicle with a whip antenna or a cell phone, the antenna used is typically vertically polarized. Aircraft or unmanned airborne vehicles typically use horizontal polarization. Circular polarization is typical of satellite communications. Also, radars are typically switchable between linear and circular polarizations. Moreover, polarization diversity is used to keep bit error rates low or to increase the quality of communications. Having the polarization of an antenna switchable is thus beneficial.

SUMMARY OF THE INVENTION

In order to provide the ability to switch from a linearly polarized to a circularly polarized Vivaldi notch/meander line loaded antenna, and vice versa, in the subject invention, the top Vivaldi notch/meander line loaded antenna structure which is intended to have side plates, has its Vivaldi notch structure duplicated in the side plates as well as being duplicated in a bottom plate such that the antenna in essence looks like a square horn in cross section, with the side plates connected to associated Vivaldi notch bearing plates by meander lines.

In one embodiment, a meander line connects a top plate to an orthogonal adjacent side plate bearing the Vivaldi notch structure. This is duplicated for all four sides of the horn, with the feed points for each of the four Vivaldi notches being fed in such a fashion that one can establish a vertical polarization, a horizontal polarization, a right hand circular polarization, or a left hand circular polarization.

The following mode table characterizes the feed characteristics for feed points A, B, C, and D to provide for the required polarization characteristic of the antenna:

| | $V_{pol}$ | $H_{pol}$ | $RH_{Cpol}$ | $LH_{Cpol}$ |
|---|---|---|---|---|
| A | 1 | 0 | 1 | 1 |
| B | 0 | 1 | −I | +i |
| C | 1 | 0 | 1 | 1 |
| D | 0 | 1 | −I | +i |

Here i indicates a 90° phase shift. In one embodiment, the meander line structures rather than them being carried exteriorly on each of the plates, are carried internal to the horn.

When these square horn shaped elements are placed side by side in an array or are concatenated, the arraying itself of the elements increases the ultra widebandwidth capabilities of the array.

In a transmitting scenario, it will be seen that for vertical polarization, the feed points for the top and bottom are driven in-phase, whereas the side plates remain undriven. For a horizontal polarization, the opposed side plates are driven in-phase, with the top and bottom plates being undriven. For right hand circular polarization and left hand circular polarization, the opposed side plates are driven in-phase, whereas the opposed top and bottom plate feeds are driven with a −90° phase shift for right hand polarization, and with a 90° phase shift for left hand circular polarization.

Generation of the appropriate feed signals is simply accomplished using a standard quadrature hybrid combiner coupled to linear combiner, or conversely in the receive mode by using a combination of the standard quadrature hybrid combiner with linear combiners, one can process the output signals from the antenna so as to give the antenna the selected polarization characteristic.

Note that the cross-polarization is about half of the port isolation.

It will be appreciated that what is needed to provide the dual polarity is to change the rectangular solid side plate of a Vivaldi notch/MLA antenna and convert it into another Vivaldi notch/meander line loaded antenna by patterning the Vivaldi notch into the side plates. Thus what one has done is to utilize a second Vivaldi notched plate as a substitute for the side plate for the original antenna. It will be appreciated that the purpose of the side plate is to give the structure a dipole response, in which the meander line loaded antenna has both vertical and horizontal plates, with meander lines attached between the vertical and horizontal plates. The result is that in converting the vertical or side plates into a Vivaldi notch/MLA structure, one can obtain a three-dimensional device which when fed appropriately, can be provided with a right hand polarization characteristic, a left hand polarization characteristic, a horizontal polarization characteristic, or a vertical polarization characteristic.

As noted above, there is virtually no interaction between the separate Vivaldi notch/MLA antenna elements. When feeding the opposed side plates in-phase, and looking at the current induced in the top and bottom plates, terminated at 50 MHz, one finds almost no cross talk. Here the cross talk is 20 dB down. With cross talk down 20 dB at 50 MHz, at the high end the cross talk is more than 40 dB down.

The fact that cross talk is minimal is positive, because one always wants to have the antenna lobes that are independent and orthogonal. As measured, it has been found that these lobes are in fact independent and orthogonal.

In summary, the combination of a Vivaldi notch and a meander line loaded antenna for ultra wide bandwidth is provided with dual polarity by providing orthogonally oriented Vivaldi notched structures coupled to each other at the edges thereof. Mode selection is provided by selectively switching between linear and circular polarization modes through selective input coupling techniques. Each side of the dual polarity Vivaldi notch/MLA plates includes a bifurcated plate with one end of the bifurcated plate having exponentially curved Vivaldi notch surfaces ahead of a cavity opened at the rear end to the bifurcation notch. The side plates for the top plate structure are themselves Vivaldi notch structures, with their side plates being the ajoining top or bottom plate. In each case, internally carried meander lines connect the adjacent plates together.

BRIEF DESCRIPTION OF THE DRAWINGS

These and other features of the subject invention will be better understood in connection with the Detailed Description in conjunction with the Drawings, of which:

FIG. 3A is a diagrammatic illustration of the modification of the combined Vivaldi notch and meander line loaded antenna of FIG. 2 to permit switching between dual polarizations through the selective application of different feeds to the feed points thereof, indicating a square horn configuration;

FIG. 3B is a block diagram of the processing unit of FIG. 3A showing the generation of the various polarizations;

FIG. 4 is a mode table indicating the signals applied to the various feed points of the antenna of FIG. 3A, indicating the ability to switch from vertical polarization, to horizontal polarization, to right hand circular polarization, and to left hand circular polarization;

DETAILED DESCRIPTION

Figure 1:
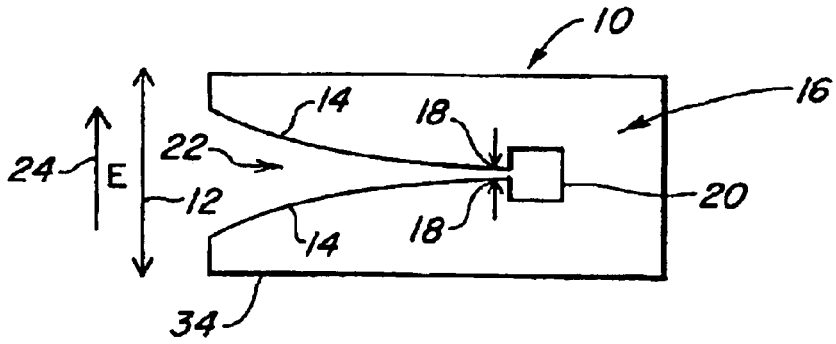
FIG. 1 is a diagrammatic view of a Vivaldi notch antenna illustrated as having exponentially curved notch edges as well as a rear cavity.

Before discussion of the modifications to a linear polarized combined Vivaldi notch/meander line loaded antenna configuration which results in the ability to switch between linear polarizations and circular polarizations, and referring now to FIG. 1, a discussion is presented of the design characteristics of an ultra wideband single lobe forward-firing Vivaldi notch/meander line loaded antenna.

Referring to FIG. 1, a Vivaldi notch waveguide antenna 10 is illustrated as having an aperture 12 which is formed by exponentially shaped edges 14 in a plate 16. The antenna has a pair of feed points 18 which are adjacent the region of closest approximation of edges 14. Behind the feed point is a cavity 20, the purpose of which is to reflect back any rearwardly projecting radiation out through the notch which is defined by edges 14. The notch is therefore established by these edges as notch 22. Note that the E-field for the Vivaldi notch antenna Figure is as illustrated by arrow 24.

As mentioned hereinbefore, it is a feature of the Vivaldi notch antenna that its upper frequency cut-off is virtually unlimited. Thus it is typical for the Vivaldi notch antennas to operate from for instance from 100 MHz up to 10–20 GHz.

While this wide bandwidth operation is desirable, in some instance, the low frequency cut-off of such a Vivaldi notch antenna is restricted due to the fact that as one descends lower and lower in frequency, the feed is looking into a dead short. The result is no effective radiated energy below 100 MHz.

Figure 2:
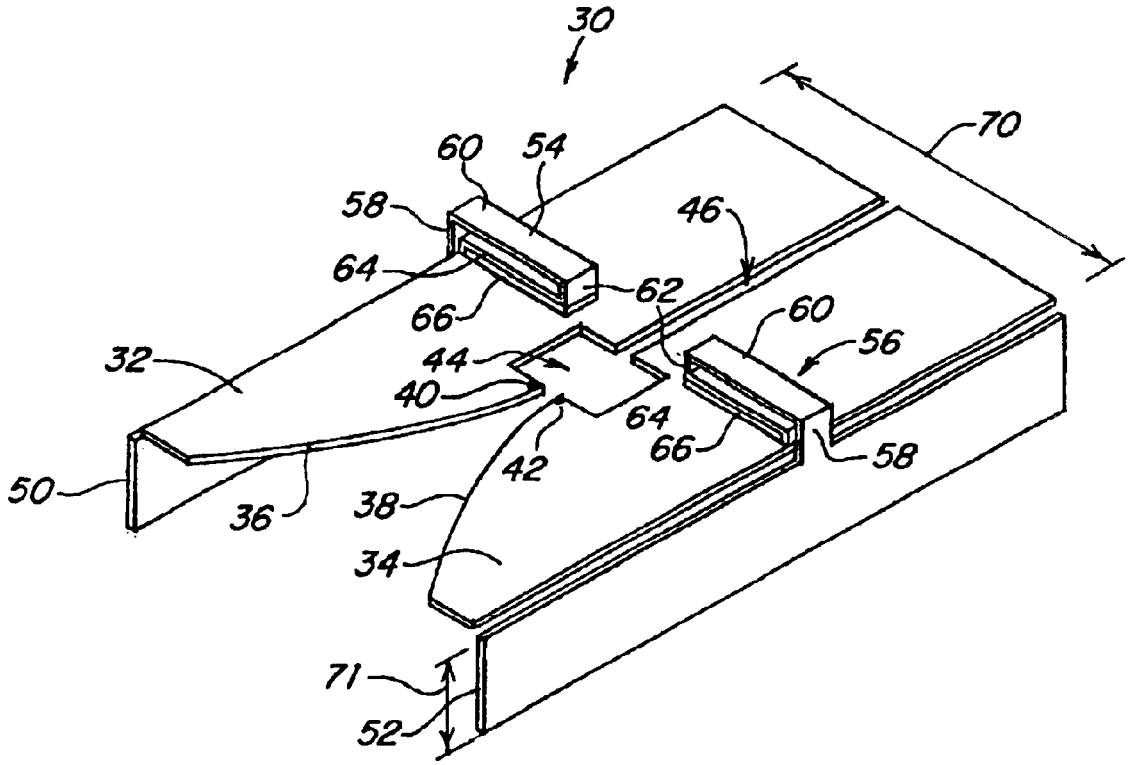
FIG. 2 is a diagrammatic illustration of a combination of a Vivaldi notch antenna and a meander line loaded antenna which exhibits a linear polarization characteristic.

In an effort to decrease the low frequency cut-off of the antenna FIG. 1, referring now to FIG. 2, a combined Vivaldi notch/meander line loaded antenna structure 30 is illustrated as having bifurcated top plates 32 and 34, with the top plates having exponentially shaped edges respectively at 36 and 38. The feed points 40 and 42 are at the points of closest approximation of edges 36 and 38, with a cavity 44 formed behind the feed points.

In an effort to lower the low frequency cut-off of the Vivaldi notch antenna, the top plate is bifurcated as illustrated so as to leave a slot 46 between the plates aft of cavity 44. What this does is to provide the opportunity for forming a dipole antenna having a low frequency cut-off much lower than that associated with the Vivaldi notch portion of the antenna.

In order to complete the meander line loaded proportion of the antenna, downwardly depending side plates 50 and 52 are coupled to associated top plates 32 and 34 through meander lines 54 and 56 respectively. Each of the meander lines has an upstanding portion 58, a laterally projecting portion 60, a downwardly depending portion 62, and a folded back portion 64 attached at its distal end to an edge of plate 34, with the folded back portion being electrically insulated from the respective plate by an insulating layer 66. Note that in one embodiment for a 50 MHz to 1500 MHz antenna the width 70 of the combination is 4 inches and the width 71 of the side plates is 4 inches.

It is the purpose of the meander line loaded structure to reduce the overall physical size of the dipole section of this antenna while at the same time decreasing the low frequency cut-off of this section by effectively canceling the reactance. Thus, as the operating frequency of the antenna decreases, the reactance cancellation results in a VSWR of less than 3:1 down to, for instance in one embodiment, 50 MHz, and in some instances, down to 20 MHz to 30 MHz It has been found that the operation of the Vivaldi notch is not affected by the dipole portion of the antenna and as such the top or high frequency cut-off is unaltered by the meander line structure. On the other hand, it has been found that low frequency cut-off of the combined structure is that associated with the meander line loaded antenna portion.

Additionally, it has been found that the transition between low frequency and high frequency is smooth, and that there are no discontinuities in operation as one goes from a lower frequency to a higher frequency.

At the higher frequencies, it is the Vivaldi notch portion of the antenna which is active, whereas at the lower frequencies, it is the meander line loaded antenna dipole which is active.

Moreover, the width of the antenna as illustrated by double ended arrow 70 is indeed minimized by virtue of the meander line loaded antenna structure, it being noted that the meander line loaded structure is in general utilized to provide miniaturization for antennas by reducing the overall size of the antennas involved.

In terms of the antenna pattern from the antenna of FIG. 2, it is desirable to have a single lobe uncorrupted by multiple lobes when the antennas are arrayed. As mentioned hereinbefore, it is important that at the highest frequency of operation, the width 70 be no greater than 0.5 wavelengths. The width reduction due to the meander line loading antenna portion satisfies this requirement up to and including 5 GHz.

Switchable Polarization

Referring now to FIG. 3A, what is now presented is the manner in which the antenna of FIG. 2 can be modified in order to provide a structure which enables switching between linear and circular polarizations.

Here a square cross-sectioned horn structure 80 has a top plate 82 which is identical to the plates 32 and 34 of FIG. 2. However, the side plates, rather than being of the type illustrated at 50 and 52 in FIG. 2, are configured themselves to carry a Vivaldi notch. Thus, side plate 84, which is duplicated on the other side at 86, is shown to have the same type of Vivaldi notch defined by edges 88 and 90 as are in top plate 82. Here these edges carry reference characters 88' and 90', with the edges in side plate 86 having an edge 88" and edge 90". Note that sides 84 and 86 are orthogonal to top plate 82 which, inter alia, has a cavity 92 and bifurcation slot 94 therein. This cavity and slot configuration is duplicated in the two side plates and in the bottom plate of the antenna now to be described.

It is noted that a bottom plate 100 is utilized to complete the horn structure, with the Vivaldi notch therein defined by edges 88'" and 90'".

For convenience, the feed points for side plate 86 are designated A, for top plate 82 are designated B, for side plate 84 are designated C, and for bottom plate 100 are designated D. It is these feed points, when appropriately connected to a processor 101 that provide for a vertical polarization, a horizontal polarization, a right hand circular polarization, or a left hand circular polarization.

What will be apparent from looking at the square horn structure of FIG. 3A is that a Vivaldi notch/MLA structure is substituted for the usual side plate in a linearly polarized Vivaldi notch/MLA antenna. Moreover, what will be noticed is that meander line structures, here shown in dotted outline at 102, 104, and 208, couple the respective Vivaldi notch-bearing plates to their side plates. Note, the coupling between side plate 86 and bottom plate 100 is accomplished by meander line structure 106.

Referring to FIG. 3B, processor 101 of FIG. 3A may include a linear combiner 103 having as inputs feed points B and D to provide a horizontal polarization for the antenna of FIG. 3A. As to vertical polarization, a linear combiner 105 has inputs from feed points A and C of the antenna of FIG. 3A, thus to give the antenna a vertical polarization characteristic. If one wants to provide the antenna with either a right hand circular polarized or a left hand circular polarized characteristic, then the outputs of combiners 103 and 105 are applied to a quadrature hybrid combiner 107 with the outputs thereof being right hand circularly polarized and left hand circularly polarized.

The processing of FIG. 3B is the processing for a receive mode, in which the antenna is given switchable polarization characteristics in accordance with the mode table of FIG. 4 to be described hereinafter. Note, however, that processing 101 can be operated in reverse to provide a switchable polarization characteristic for transmission, with the combiners operating in a bidirectional fashion, given the connections illustrated in the mode table.

Referring to FIG. 4, in the case of transmission, what can been seen from the mode table is that if one wishes to give the antenna of FIG. 3A a vertical polarization, then one couples combiner 101 to feed points A and C in-phase, and does not couple the combiner to points B and D at all. If one wishes to provide the antenna of FIG. 3A with a horizontal polarization, then one couples combiner 101 to points B and D and drives points B and D with in-phase signals, leaving feed points A and C devoid of input signals.

For a right hand circular polarized result, combiner 101 drives feed points A and C with in-phase signals, and drives feed points B and D with −90° out of phase signals, whereas for a left hand circular polarization result, one likewise drives feed points A and C with in-phase signals, but rather provides feed points B and D with +90° phase shifted input signals.

Figure 5A:
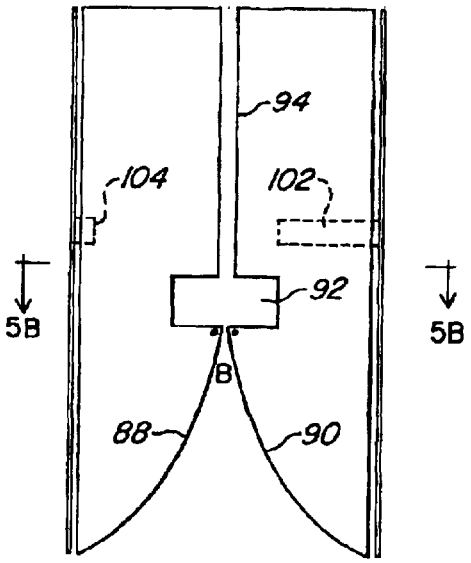
FIGS. 5A, 5B and 5C are front, top and side views of the dual polarity antenna of FIG. 3, illustrating the placement of the meander lines internal to the horn structure.
Figure 5B:
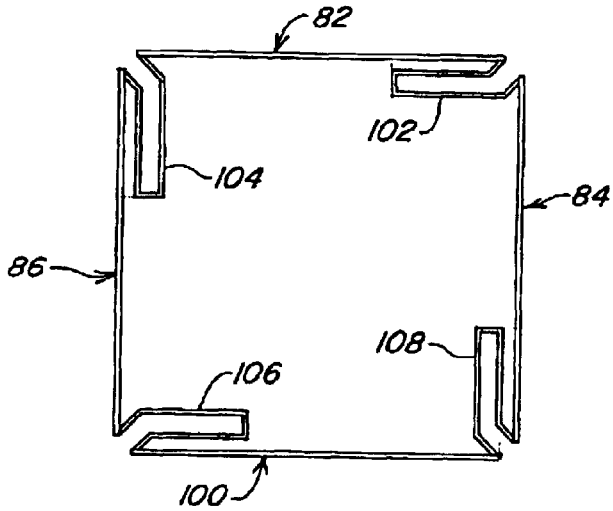
Figure 5C:
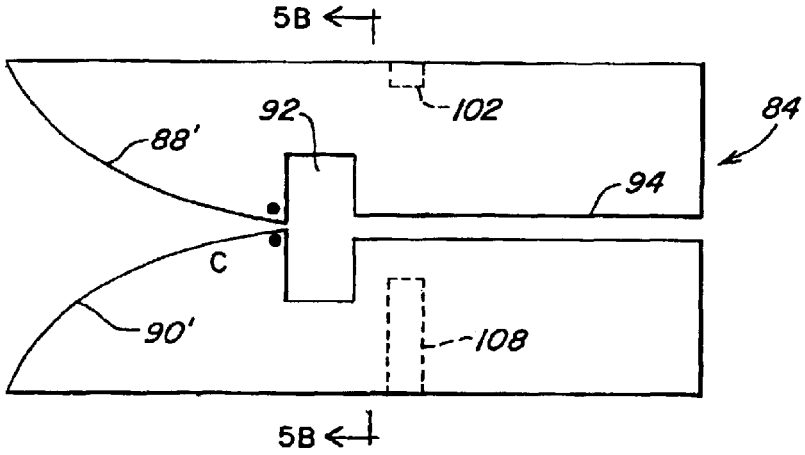

Referring to FIGS. 5A, 5B, and 5C, what will be seen is that a cross-section of the antenna of FIG. 3 along dotted line 5B, results in a cross-section clearly showing the placement of the meander line structures 102–108 interior of the horn.

As will be appreciated, it is the purpose of the meander line structures to complete the dipole portion of the combined antenna. Moreover, it is been found that the particular placement of the meander lines is not particularly critical, although the symmetric pinwheel type arrangement shown in FIG. 5B provides a preferred antenna configuration.

Figure 6:
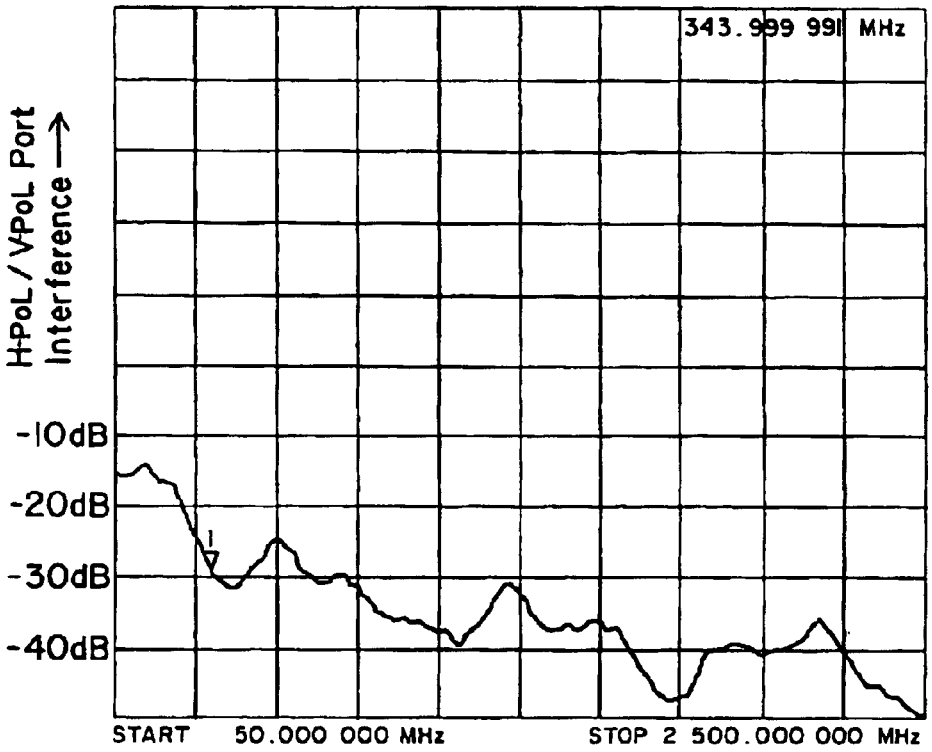
FIG. 6 is a graph of horizontal/vertical polarization port isolation from 50 MHz to 2500 MHz.

Referring to FIG. 6, a horizontal/vertical port isolation graph indicates that from 50 MHz to 2500 MHz, the isolation is quite good.

Figure 7:
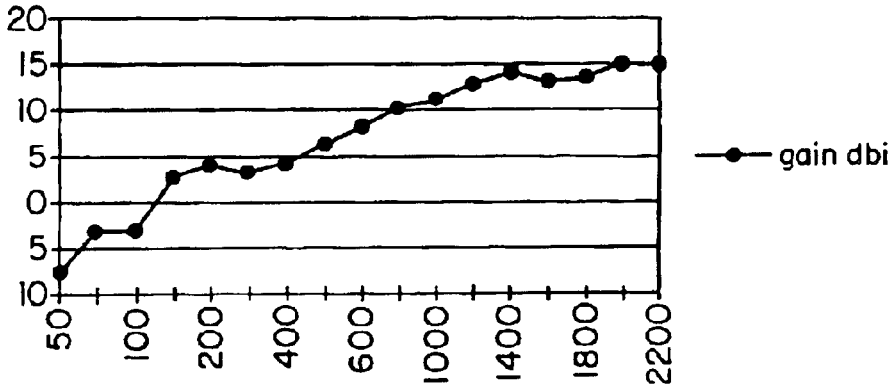
FIG. 7 is a graph illustrating the gain of the antenna of FIG. 3 versus frequency.
Figure 8:
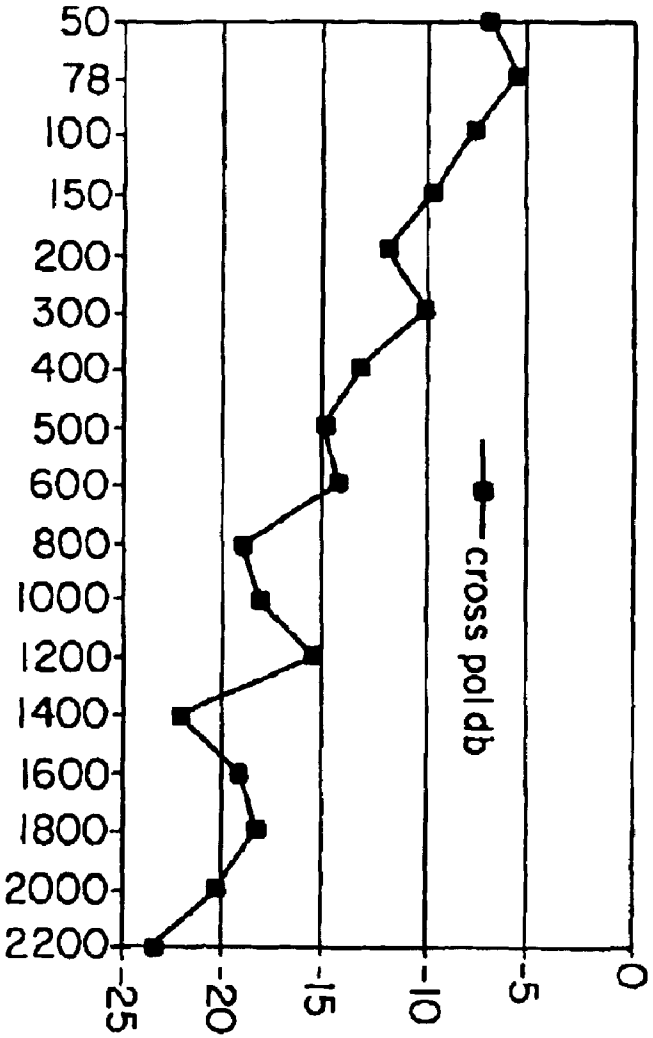
FIG. 8 is graph showing the cross polarization isolation for the antenna of FIG. 3.

Referring to FIG. 7, a gain graph is presented which shows that the gain for the ultra wideband antenna of FIG. 3 over a ground plane, goes from about −7 dBI at 50 MHz, all the way up to a 15 dBI gain at 2500 MHz Referring to FIG. 8, a graph is shown of cross-polarization isolation, which is about half the port to port isolation and therefore represents the fact that there is minimal interference between the ports of the antenna of FIG. 3A.

Having now described a few embodiments of the invention, and some modifications and variations thereto, it should be apparent to those skilled in the art that the foregoing is merely illustrative and not limiting, having been presented by the way of example only. Numerous modifications and other embodiments are within the scope of one of ordinary skill in the art and are contemplated as falling within the scope of the invention as limited only by the appended claims and equivalents thereto.

What is claimed is:

1. A polarity switchable combined Vivaldi notch/meander line loaded antenna, comprising:

a top plate having a Vivaldi notch antenna therein;

a pair of side plates each having a Vivaldi notch therein;

a bottom plate having a Vivaldi notch therein, each of said Vivaldi notches having a throat and a feed point at said throat;

meander lines electrically connecting adjacent plates together and;

a processor coupled to selected feed points for selectively providing said antenna with a horizontal polarization, a vertical polarization, a right hand circular polarization or a left hand circular polarization.

2. The antenna of claim 1, wherein each of said plates has a slot extending rearwardly of said Vivaldi notch.

3. The antenna of claim 2, wherein adjacent edges of said plates are spaced apart.

4. The antenna of claim 3, wherein said meander lines bridge respective spaced apart plates.

5. The antenna of claim 2, and further for each plate including a cavity interposed between the throat of a Vivaldi notch and the associated slot, thus to provide an end-fire antenna.

6. The antenna of claim 1, wherein said processor includes a linear combiner and a quadrature hybrid combiner coupled thereto.

7. The antenna of claim 6, wherein the feed for said top plate is denoted B, wherein the feeds for the side plates are respectively denoted A and C, and wherein the feed for the bottom plate is denoted D and wherein the mode of operation of said antenna as determined by said processor is:

| | $V_{pol}$ | $H_{pol}$ | $RH_{Cpol}$ | $LH_{Cpol}$ |
|---|---|---|---|---|
| A | 1 | 0 | 1 | 1 |
| B | 0 | 1 | −i | +i |
| C | 1 | 0 | 1 | 1 |
| D | 0 | 1 | −i | +i |

8. The antenna of claim 1, wherein said plates form a retilinear horn, and wherein said meander lines are carried internal to said plates.

9. The antenna of claim 8, wherein said meander lines are arrayed in a symmetric pattern.

10. The antenna of claim 9, wherein said symmetric pattern includes a pedal pattern.

11. The antenna of claim 10, wherein said meander lines point around a cross-sectioned horn periphery in the same direction.

* * * * *